United States Patent [19]

Ambrosini et al.

[11] 4,176,608

[45] Dec. 4, 1979

[54] ELECTRICALLY ENERGIZED IMPACT DETONATED PROJECTILE WITH SAFETY DEVICE

[75] Inventors: Leonard R. Ambrosini, Bettendorf, Iowa; Joseph O. Juliano, West Orange, N.J.; Charles H. Rarick, Dewitt, Iowa

[73] Assignee: The United States of America as represented by the Secretary of the Army, Washington, D.C.

[21] Appl. No.: 904,052

[22] Filed: May 8, 1978

[51] Int. Cl.[2] ..... F42C 15/14

[52] U.S. Cl. ..... 102/216; 102/210

[58] Field of Search ..... 102/216, 210

[56] References Cited

U.S. PATENT DOCUMENTS

| | | | |
|---|---|---|---|
| 2,934,017 | 4/1960 | Ellett | 102/210 |
| 3,054,352 | 9/1962 | Perdreaux, Jr. et al. | 102/216 |
| 3,196,794 | 7/1965 | Meade | 102/210 |
| 3,340,811 | 9/1967 | Gauld | 102/210 |
| 3,359,904 | 12/1967 | Nerheim | 102/210 |
| 3,540,377 | 11/1970 | Juliano et al. | 102/210 |
| 3,788,225 | 1/1974 | Held | 102/216 |
| 3,967,555 | 7/1976 | Gawlick et al. | 102/210 |

*Primary Examiner*—Charles T. Jordan

*Attorney, Agent, or Firm*—Nathan Edelberg; Robert O. Richardson

[57] ABSTRACT

Projectiles exist with a stored electrical charge during flight and an electrically energized detonator which activates upon impact. Premature activation in flight, which can be caused by spurious voltage, is eliminated by the addition of a voltage threshold blocking device. Detonator activation will then occur, as intended, by the voltage released upon impact.

5 Claims, 3 Drawing Figures

ELECTRICALLY ENERGIZED IMPACT DETONATED PROJECTILE WITH SAFETY DEVICE

GOVERNMENT RIGHTS

The invention described herein may be manufactured and/or used by or for the Government for governmental purposes without the payment of any royalty thereon.

BACKGROUND OF THE INVENTION

Anti-materiel projectiles are designed to detonate upon impact with a target. This gives the projectile a greater destructive force when it hits buildings, bridges, tanks and other hard-to-penetrate objects. In accomplishing this, an impact actuated switch closes an electrically charged circuit upon impact to electrically energize and actuate the detonator.

A problem has arisen in that detonation sometimes occurs prematurely when the projectile is still in flight. When this occurs, the projectile self-destructs before hitting the target and the target is neither hit nor destroyed. Previous attempts to overcome this problem involved desensitizing the piezoid by shock isolation techniques, piezoid redesign, and additional stabilization provided by enlarging the projectile fins to reduce vibration.

SUMMARY OF THE PRESENT INVENTION

In accordance with the present invention a projectile is provided with electrically energized impact detonation characteristics wherein a voltage threshold blocking device is provided in the circuit to prevent spurious voltages from prematurely activating the detonator in flight.

The projectile fuzing apparatus consists of three principal elements, the base fuze, the piezoelectric power supply, and the full frontal area impact switch. The base fuze contains the detonator for the shaped charge. It is isolated from the rest of the round with a safing and arming device until the round is in flight. The piezoelectric crystal generates electrical energy upon setback restoration (deceleration) and stores that energy during flight until impact. The impact switch closes the circuit to function the round upon impact anywhere on the frontal portion of the round.

DETAILED DESCRIPTION OF ILLUSTRATIVE EMBODIMENTS

Figure 1:
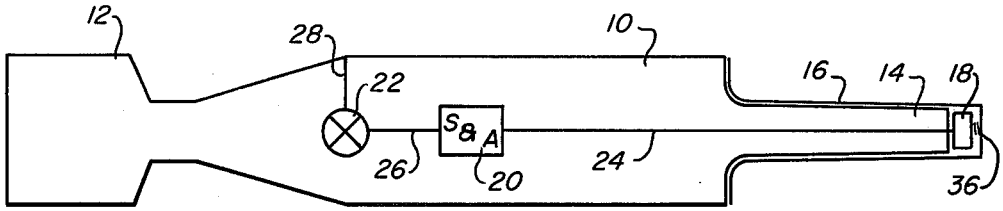
FIG. 1 is a schematic illustration of a projectile with impact detonation characteristics.

Reference is made to FIG. 1 wherein there is shown a projectile body 10 having stabilizing fins 12 and a nose section 14. The nose section is covered with an aluminum/plastic shroud impact switch 16 held in position by a threaded connection. This shroud is electrically connected to a power supply 18 and becomes an impact switch by contacting the projectile body 10 when any part of it hits the target. This completes the electrical circuit between the power supply 18, safing and arming apparatus 20, detonator 22 and the projectile body 10.

Leads 24, 26 and 28 make the appropriate interconnections. Thus, upon impact, the shroud-projectile body impact switch closes and the detonator is electrically actuated and initiates the explosive train. The projectile preferably is of a shaped charge type with armor piercing capabilities.

Figure 2:
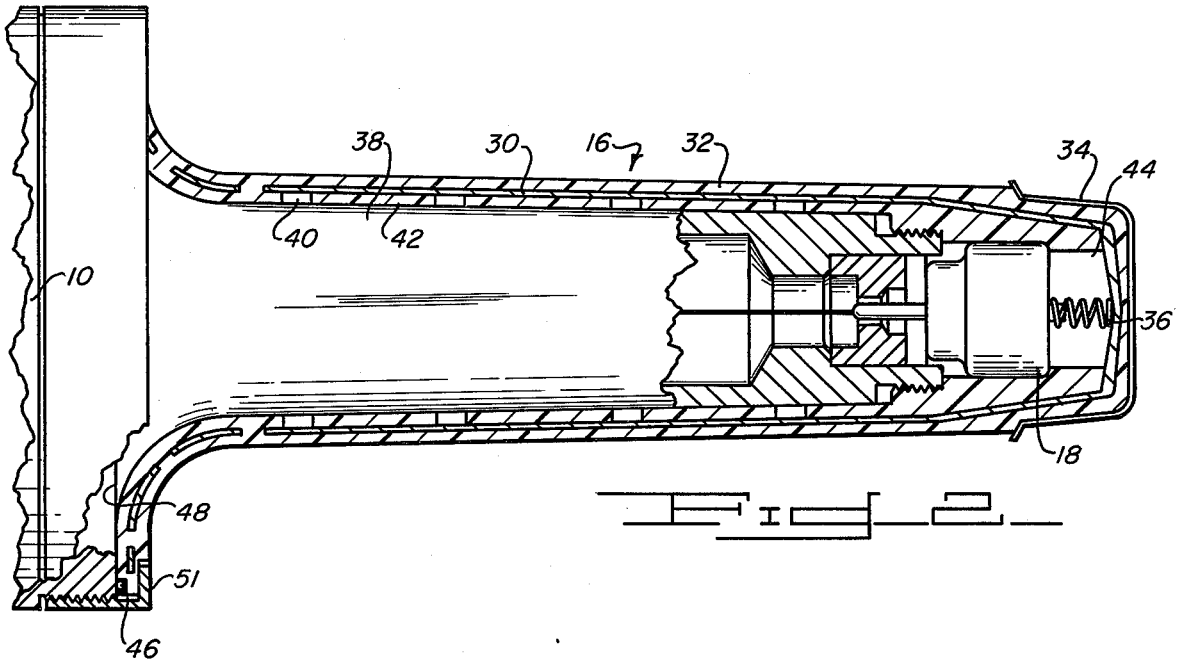
FIG. 2 is an enlarged sectional view of the impact switch.

FIG. 2 is a sectional view of the full frontal area impact switch. This switch 16 consists of an aluminum trumpet shaped cup 30 molded within a glass filled plastic shroud 32. An aerodynamic deflector cap 34 fits over the end of the switch. The cup is connected electrically through contact 36 to the power supply 18 and in turn to the detonator, and is separated from the projectile spike 38 by an air gap 40 maintained by plastic ribs 42 until target impact causes the cup to contact the spike to complete the electrical circuit for detonation. The impact switch 16 is threadedly connected to the nose 44 of the projectile spike 38 and a locking ring 51 and an O-ring 46 is used to maintain the structural and waterproof interfaces against shoulder 48 of projectile 10.

Figure 3:
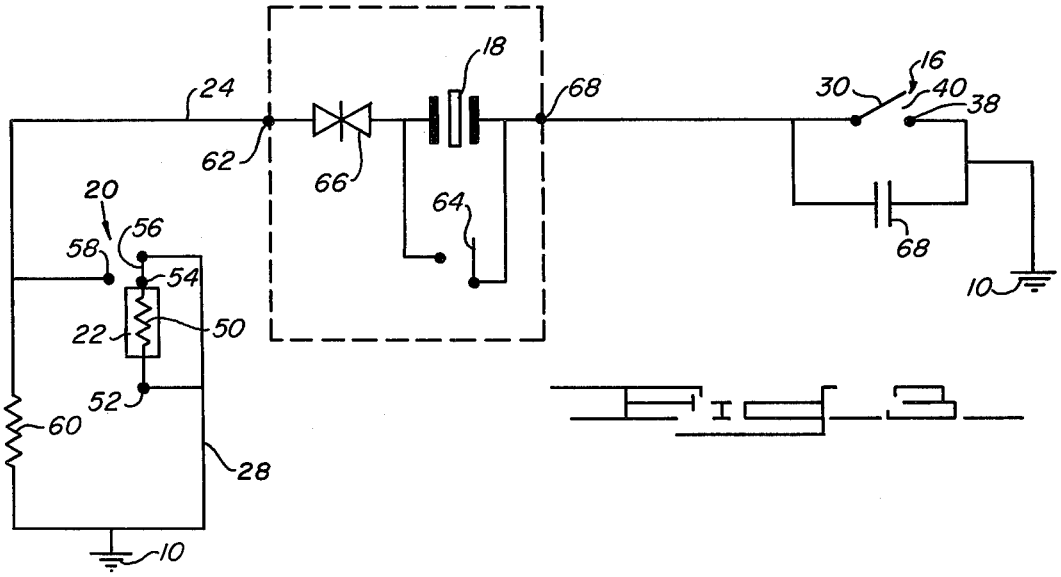
FIG. 3 is a schematic illustration of the electrical circuit.

The electrical circuit and operation of the projectile can best be understood with reference to the schematic shown in FIG. 3. Here is shown a base fuze 50 including the detonator 22 for initiation of the shaped charge. One end 52 is grounded to the projectile body 10 through lead 28 and the other end 54 is connected to an inertia switch 56. Lead 26 in FIG. 1 is not needed in FIG. 3 for this purpose. During setback; i.e., when the projectile is launched from the gun tube, this switch makes contact at terminal 58 to place the detonator 22 in the circuit. The detonator resistance of 1,000 ohms is in parallel with a 200K ohm resistor 60.

Lead 24 connects the inertia switch contact 58 with the negative terminal 62 of the piezoelectric power supply 18. Preferably it is a 3,000 picofarad lead zirconate titanate crystal which generates electrical energy upon setback and setback restoration in opposite polarity. A cantilever beam shorting switch 64 is connected to both sides of the power supply 18. It is a resilient spring-like bar that makes contact to short out the power supply 18 during setback when the lead zirconate titanate is under stress and is generating energy. After the setback level has reached its peak value and has then diminished to a predetermined design point, the shorting beam 64 reopens. At this point the crystal 18 is being relaxed from its stress level at peak acceleration, and consequently is regenerating a voltage of opposite polarity. This voltage is then stored during flight on the piezoelectric crystal which acts as a storage capacitor.

A back-to-back Zener diode 66 is connected between the negative terminal 62 of the power supply and the safety and arming base fuze 50. This diode is of such voltage threshold level that it acts as an open circuit; i.e., maximum impedance, for up to 20 volts and as a short circuit; i.e., no impedance, for larger voltages. In this manner spurious voltages up to 20 volts produced while the projectile is in flight will not activate the armed detonator 22 for a premature or mid-air explosion.

The aluminum shroud 16 forms the impact switch with its metallic cup 30 in electrical contact with the power supply 18, including the Zener diode 66. The projectile spike 38 is spaced from the cup 30 by an air gap 40 until impact causes the cup 30 to contact the spike 38. Spike 38 connects with the projectile body 10 to complete the circuit. Capacitor 68 is shown connected across the switch 16 to illustrate its capacitive effect when open. This capacitance is rated at 350 picofarads. Vibration of the projectile in flight could vary the capacitive spacing across the switch, generating spurious voltages which, but for the Zener diode 66, would activate the detonator 22.

OPERATION

The operation of the system is basically simple. During setback in the gun the arming switch 56 is activated, eventually placing the detonator in the electrical circuit. Concurrently the shorting bar 64 shorts out the power supply as the piezoelectric crystal is stressed and is generating a charge. While the projectile is in flight, the shorting bar then reopens and the crystal relaxes from its stress level at peak acceleration and regenerates a voltage of opposite polarity. This voltage is stored during flight on the piezoelectric crystal which acts as a storage capacitor. Thus, energy is available for setting off the detonator prior to the time the projectile reaches its target. During flight, spurious voltages developed are filtered out by the Zener diode to prevent inflight detonation. Impact with the target anywhere along the frontal area of the projectile will crush the impact switch through the air gap, causing contact between the switch and spike of the round, and completing the circuit between the power supply and the detonator. The energy stored in the power supply is thus delivered to the detonator which is then actuated.

The invention in its broader aspects is not limited to the specific combinations, improvements and instrumentalities described but departures may be made therefrom within the scope of the accompanying claims without departing from the principles of the invention and without sacrificing its chief advantages.

What is claimed is:

1. A projectile having impact detonation characteristics including:

a firing circuit for energizing a detonator upon target impact, an inertia switch, a base fuze having said detonator with said inertia switch connecting said detonator into said firing circuit, a power supply, an impact switch, and a voltage threshold limiting device connected in circuit to prevent energization of said circuit when voltages are generated in said circuit below a predetermined threshold level, said power supply having a setback shorting bar thereacross to prevent circuit energization during setback, said shorting bar thereafter permitting energization upon opening after setback.

2. A projectile as set forth in claim 1 wherein said power supply is a lead zirconate titanate crystal.

3. A projectile as set forth in claim 1 wherein said voltage threshold limiting device is a Zener diode.

4. A projectile as set forth in claim 3 wherein said Zener diode impedes voltages up to 20 volts and short circuits voltages of greater magnitude.

5. A projectile as set forth in claim 3 wherein said Zener diode is connected in circuit between said detonator and said power supply.

* * * * *